United States Patent [19]

Johnston

[11] 4,378,944

[45] Apr. 5, 1983

[54] PROJECTILE AND TETHERED TARGET GAME APPARATUS

[76] Inventor: Robert J. Johnston, 2705 Cherrywood Rd., Minnetonka, Minn. 55343

[21] Appl. No.: 272,495

[22] Filed: Jun. 11, 1981

[51] Int. Cl.[3] ..... F41J 7/02; A63F 9/02

[52] U.S. Cl. ..... 273/393; 273/45

[58] Field of Search ..... 273/37, 38, 40, 45, 273/393

[56] References Cited

U.S. PATENT DOCUMENTS

| | | | |
|---|---|---|---|
| 722,220 | 3/1903 | Finney | 273/393 X |
| 808,959 | 1/1906 | Vinson et al. | 273/45 |
| 1,259,543 | 3/1918 | Makray | 273/40 |
| 1,608,447 | 11/1926 | Wade | 273/38 |
| 4,330,130 | 5/1982 | Carr | 273/393 |

*Primary Examiner*—Anton O. Oechsle

*Attorney, Agent, or Firm*—Burd, Bartz & Gutenkauf

[57] ABSTRACT

A game apparatus including a stand having a generally horizontal platform connected to a generally upright column. The platform has a plurality of distinct sides with point value indicia associated with each of these sides. A target object is placeable on the platform and is connected to the platform by tether means. A projectile is thrown at the target object from a remote distance with the object of knocking the target object from the platform over one of said sides. The points awarded the player participant throwing the projectile depends on which of the sides of the target is knocked over.

9 Claims, 10 Drawing Figures

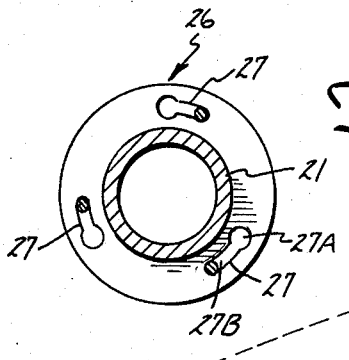
Fig. 4
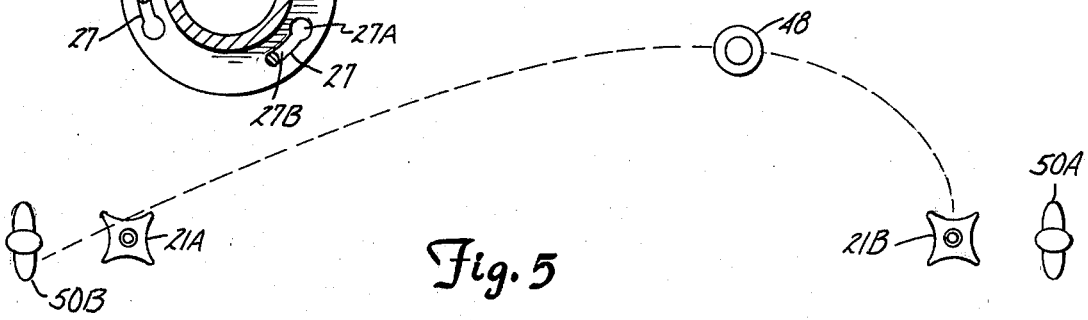
Fig. 5
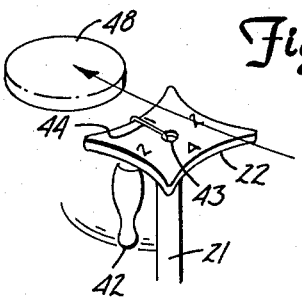
Fig. 6
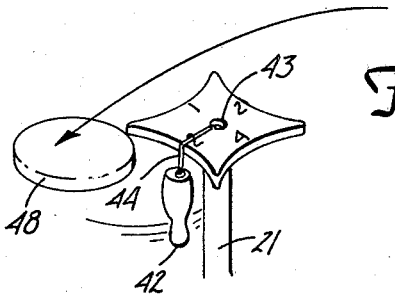
Fig. 7
Fig. 8
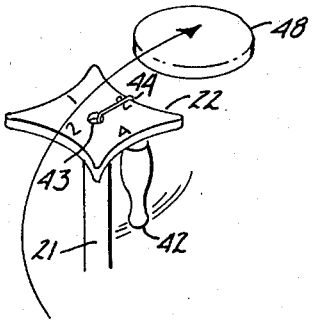
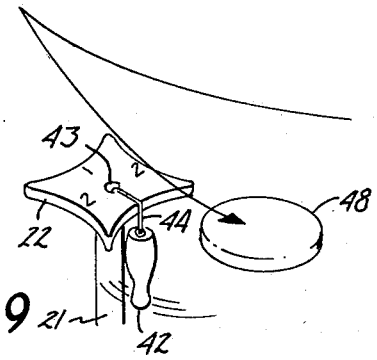
Fig. 9
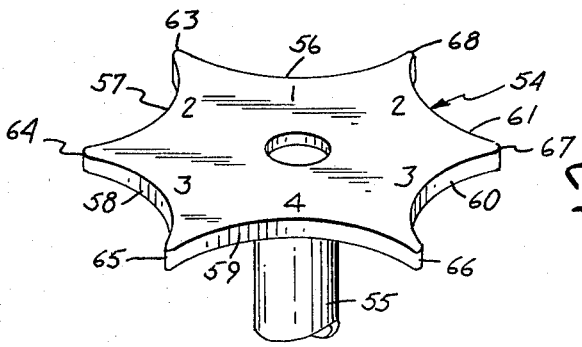
Fig. 10

PROJECTILE AND TETHERED TARGET GAME APPARATUS

SUMMARY OF THE INVENTION

A popular form of exercise and recreation consists of two or more participants throwing back and forth a plastic disc sold under the registered trademark Frisbee. The plastic disc has curved edges and a slightly rounded mid-portion which enables certain aerodynamic properties to be imparted to it by the person throwing it. By imparting various amounts of spin to the object as it is thrown, it can be made to turn left or right or even to reverse direction.

The present invention pertains to a game apparatus having a stand including a vertical support column and a generally horizontal multi-sided platform. A tenpin shaped target object is rested on the platform and is connected to the stand by an elongate tether. From a prescribed distance away, a game participant throws a projectile at the target object with the objective of knocking it from the platform to be suspended by the tether adjacent a side. The sides of the platform are distinct and separated by corners. Various point values are scored by the participant depending on the side of the platform over which the target object falls and is suspended by the tether. The least amount of points is gained by the participant when the projectile approaches the target object from a straight ahead direction and simply knocks it rearwardly over the rear side of the platform. A preferred form of projectile is a disc having aerodynamic properties of the type described which can be made to approach the target object in other than a straight ahead direction. The disc can be made to turn left or right to approach the target object from a lateral side and knock it off a lateral side of the platform to thereby gain the participant a greater number of points. The most difficult maneuver is to knock the target object over the forward edge of the platform which requires an inflight reversal of direction of the projectile. This maneuver gains the greatest number of points for the participant. The game can be played by two persons, each stationed near a stand and platform with a target object, and throwing a single projectile back and forth while attempting to knock over the target object on the stand near the opposite participant. The game is ended when one participant first gains a predetermined number of points.

IN THE DRAWINGS

FIG. 4 is a sectional view of a portion of the game stand of FIG. 3 taken along the line 4—4 thereof;

FIG. 5 is a diagrammatic view of a game arrangement utilizing the platform and target object of FIG. 1 and a throwing disc;

FIGS. 6, 7, 8 and 9 are diagrammatic views depicting various modes of scoring points with the apparatus of the invention; and FIG. 10 is a perspective view of an alternative embodiment of a platform for the game stand of the invention.

DESCRIPTION OF A PREFERRED EMBODIMENT

Figure 1:
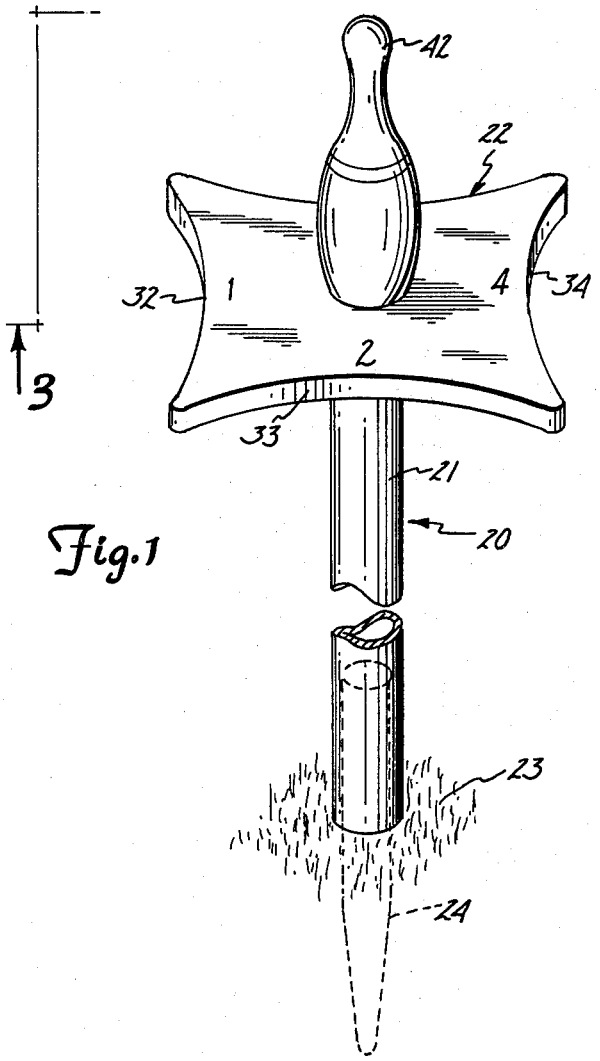
FIG. 1 is a perspective view of a game stand and target object of the game apparatus of the invention.

Referring to the drawings, there is shown in FIG. 1 a stand 20 of a game apparatus according to the invention having a generally upright tubular column 21 and a generally horizontal platform 22 mounted at the top of column 21. Column 21 is positioned in generally upright relationship with respect to the ground surface 23 by a stake 24 driven into the ground. The lower end of column 21 telescopically engages the upper end of the stake 24 extending above the ground surface. Other suitable means could be provided for anchoring the column 21.

Figure 3:
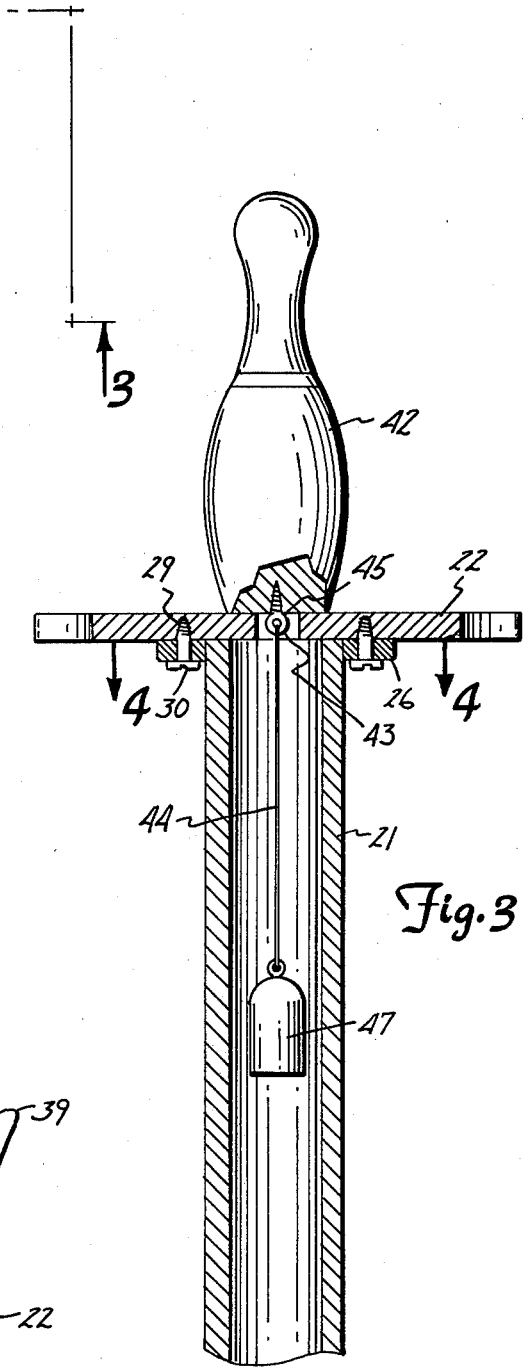
FIG. 3 is a sectional view of the game stand of FIG. 1 taken along the line 3—3 thereof.

Means for attachment of platform 22 to the column 21 are shown in FIGS. 3 and 4. A circular flange 26 is fixed in surrounding relationship to the top edge of column 21 and has a plurality of key slots 27. Each slot 27 has an enlarged head 27A and a narrower neck 27B. A plurality of screws 29 are driven in the under surface of platform 22 and have enlarged heads 30. The screws 29 are arranged in configuration to correspond to the key slots 27 of flange 26. Platform 22 is assembled to collar 21 by inserting the screws 29 through the head portions 27A of the slots 27 and then rotating the platform so that the screw shanks enter the neck portion 27B to retain platform 22 secure in place.

Figure 2:
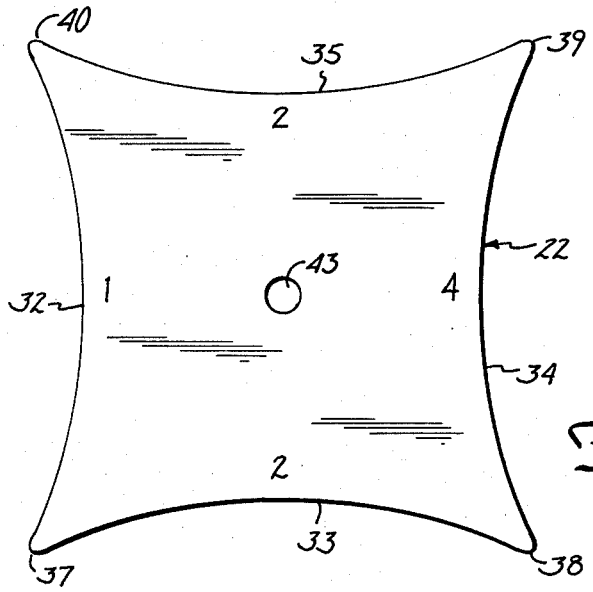
FIG. 2 is an enlarged top plan view of the platform of the game stand of FIG. 1.

Platform 22 has discrete sides 32–35 separated by corners 37–40. Sides 32–35 can be concave as shown. Indicia of point values for each separate side can be shown on platform 22, for example the numbers 1, 2, 4, 2 respectively as indicated in FIG. 2. A target object 42 shown as a bottle shaped member or tenpin rests on platform 22 poised over an opening 43. A tether 44 is connected to an eye bolt 45 secured to the bottom of target object 42 and extends through the opening 43. The opposite end of tether 44 is connected to a dead weight or ballast 47. Dead weight 47 is larger than the opening 43 whereby target object 42 is connected to the stand 20 by tether 44.

A throwing object or projectile is provided for a game participant to throw at the target 42 in an attempt to knock the target 42 from the platform 22 and receive points in an amount according to the side of platform 22 that the target 42 falls from. For example, if target 42 is knocked from side 34 to remain suspended over that side by tether 44, the game participant receives four points. A throwing object is shown to be comprised as a disc 48 of the type having rounded edges and a slightly convex surface so as to enable aerodynamic properties to be imparted to it upon it being thrown by the game participant. Such a disc is commonly known as a Frisbee.

In use of the game apparatus, the game participant stands in spaced relationship from his or her target. As shown in FIG. 5, two game participants 50A, B can play, each being spaced a distance from his or her target stand, 21A, B. As play proceeds, each player throws the disc 48 toward his intended target with the object in mind of knocking the target from the platform 22 to achieve points. If the target is knocked from the platform 22, the opposite player then replaces the target, takes the disc and throws it at his intended target with the same object in mind. The participant first achieving a predetermined number of points wins the game. The platforms are positioned so that the easiest side to knock the target from awards the least points, while the most difficult side to knock the target from awards the highest points. For example, referring to FIG. 2, assuming the projectile is thrown from right to left, the first side 32 awards the least points as this is the easiest score to achieve, requiring only a straight ahead throw. This is illustrated in FIG. 6. Knocking the target from the lateral sides 33, 35 awards an intermediate amount of points. Such a score is achieved by directing the throwing disc in such a path that it will approach the platform from either the right or the left relative to an axis between the game participant and the stand 21. This is illustrated in FIG. 7 where the disc 48 approaches the target 42 from the right, and in FIG. 8 where the disc 48 approaches the target 42 from the left. The most difficult score to achieve is to knock the target over the front side 34 or the side in facing relationship to the game participant. This requires a reversal of direction of the projectile and is illustrated in FIG. 9.

The concave shape of the respective sides of platform 22 definitively positions the tether 44 and target object 42 over one of the sides if it is knocked from platform 22. The amount of impact or accuracy needed to knock target object 42 from platform 22 can be varied by varying the weight 47. Projectiles other than a throwing disc could be used as well as different target objects.

In FIG. 10 there is shown a modified platform 54 supported on a column 55 for holding a target object. Platform 54 has six discrete sides 56–61 separated by corners 63–68. Point value indicia appear adjacent each side on the upper horizontal surface of platform 54. The lower point value sides are those over which the target object is more easily made to fall. For example, the first side 56 is adjacent the point value notation 1. This side during play of the game will be positioned as the most rearwardly side from the game participant throwing the projectile. A straight ahead path of travel of the thrown object would cause the target object to fall over this side. The most forward side or fourth side 59 is adjacent the point value indicia 4. This is the most difficult side over which to cause the target object to fall as it would require a reversal of direction of the thrown object. The second and sixth sides 57, 61 face slightly rearward relative to the play participant and pose slightly greater difficulty than the rearward facing first side 56. These sides therefor carry a slightly higher point value. The third and fifth sides 58, 60 face slightly forward and therefor have assigned a larger point value. The platform sides 56–61 are concave whereby a tether attached to a target object will be guided toward the center of the side when the target object is knocked from the platform and hangs down from it on one of the sides. Other types and shapes of platform could be used in the game apparatus of the invention.

While there has been shown and described certain preferred embodiments of a game apparatus of the invention, it will be apparent to those skilled in the art that certain deviations and alterations can be had from the embodiments shown without departing from the scope and spirit of the invention.

The embodiments of the invention in which an exclusive property or privilege is claimed are defined as follows:

1. A game apparatus comprising:

a stand having an elevated platform with a generally horizontal top surface and a plurality of discrete sides;

point value indicia associated with each of said sides;

a target object supportable on the platform;

tether means connecting the target object to the stand;

said sides being concave in shape;

a projectile throwable by a game participant to attempt to knock the target object from the platform whereby it hangs over one of said sides suspended by the tether means with the tether means giving a point value indication.

2. The game apparatus of claim 1 wherein:

said projectile comprises a throwable disc having aerodynamic properties.

3. A game apparatus comprising:

a stand having a platform with a generally horizontal top surface and a plurality of discrete sides;

point value indicia located on the platform associated with each of said sides;

a target object supportable on the platform;

tether means connecting the target object to the stand;

a projectile comprised as a throwable disc having aerodynamic properties throwable by a game participant to attempt to knock the target object from the platform whereby it hangs over one of said sides suspended by the tether means.

4. The game apparatus of claim 1 or 2 wherein:

said stand includes a tubular column supporting the platform, said platform having a central opening open to the interior of the tubular column, said tether means including a tether connected at one end to the target object, said tether extending through the central opening of the platform into the interior of the tubular column, a dead weight connected at the opposite end of the tether and located in the tubular column, said dead weight having a dimension larger than the dimension of the central opening of the platform.

5. The game apparatus of claim 4 wherein:

said platform is releasably assembled to the tubular column.

6. A game apparatus comprising:

a stand having a platform with a generally horizontal top surface and a plurality of discrete sides, and having a tubular column supporting the platform, said platform having a central opening open to the interior of the tubular column;

point value indicia located on the platform associated with each of said sides;

a target object supportable on the platform;

a tether connected at one end to the target object and extending through the central opening into the interior of the tubular column;

a dead weight connected at the opposite end of the tether and located in the tubular column, said dead weight having a dimension larger than the dimension of the central opening of the platform;

a projectile comprised as a throwable disc having aerodynamic properties throwable by a game participant to attempt to knock the target object from the platform whereby it hangs over one of said sides suspended by the tether.

7. The game apparatus of claim 6 wherein:

the sides of said platform are concave.

8. The game apparatus of claim 6 wherein:

said target object has the shape of a tenpin.

9. The game apparatus of claim 6 wherein:

said platform is releasably assembled to the tubular column.

* * * * *